US009707752B2

(12) United States Patent
Torgerson et al.

(10) Patent No.: US 9,707,752 B2
(45) Date of Patent: Jul. 18, 2017

(54) INKJET PRINT HEAD WITH SHARED DATA LINES

(75) Inventors: Joseph M. Torgerson, Philomath, OR (US); Trudy Benjamin, Portland, OR (US); Kevin Bruce, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 473 days.

(21) Appl. No.: 12/739,076

(22) PCT Filed: Nov. 14, 2007

(86) PCT No.: PCT/US2007/023991

§ 371 (c)(1),
(2), (4) Date: Apr. 21, 2010

(87) PCT Pub. No.: WO2009/064271

PCT Pub. Date: May 22, 2009

(65) Prior Publication Data

US 2010/0302293 A1 Dec. 2, 2010

(51) Int. Cl.
*B41J 2/045* (2006.01)
*B41J 2/21* (2006.01)

(52) U.S. Cl.
CPC ..... *B41J 2/04541* (2013.01); *B41J 2/04501* (2013.01); *B41J 2/04586* (2013.01); *B41J 2/2103* (2013.01); *B41J 2202/13* (2013.01)

(58) Field of Classification Search
CPC B41J 2/04541; B41J 2/04501; B41J 2/04586; B41J 2202/13; B41J 2/2103
USPC ..... 347/10
See application file for complete search history.

(56) References Cited

U.S. PATENT DOCUMENTS

| | | | | |
|---|---|---|---|---|
| 4,281,401 | A | 7/1981 | Redwine et al. | |
| 4,922,137 | A | 5/1990 | Small et al. | |
| 4,930,107 | A | 5/1990 | Chan et al. | |
| 5,363,134 | A * | 11/1994 | Barbehenn et al. | 347/49 |
| 5,757,394 | A * | 5/1998 | Gibson et al. | 347/19 |
| 5,956,052 | A | 9/1999 | Udagawa et al. | |
| 6,022,094 | A * | 2/2000 | Gibson et al. | 347/19 |
| 6,161,916 | A * | 12/2000 | Gibson et al. | 347/19 |
| 6,568,783 | B2 * | 5/2003 | Hu et al. | 347/19 |
| 6,631,967 | B1 * | 10/2003 | Saruta | 347/19 |
| 6,948,789 | B2 * | 9/2005 | Imanaka et al. | 347/9 |

(Continued)

FOREIGN PATENT DOCUMENTS

JP 2002-67290 3/2002

OTHER PUBLICATIONS

Supplementary European Search Report for Application No. EP07862050.7 Report issued Nov. 4, 2010.

*Primary Examiner* — Manish S Shah
*Assistant Examiner* — Yaovi M Ameh
(74) *Attorney, Agent, or Firm* — Thorpe North & Western, LLP

(57) ABSTRACT

An inkjet print head includes data signal lines configured to supply inkjet control voltages and non-volatile memory cell random access addresses. The inkjet print head includes an inkjet nozzle array wherein each nozzle in the array is configured to communicate with a data signal line. Also a non-volatile attribute memory cell array is included in the inkjet print head wherein each memory cell in the array is accessed through a data signal line shared with the nozzle array.

13 Claims, 3 Drawing Sheets

(56) References Cited

U.S. PATENT DOCUMENTS

| | | | | |
|---|---|---|---|---|
| 7,075,674 | B2 * | 7/2006 | Nagumo et al. | 358/1.16 |
| 7,198,348 | B2 * | 4/2007 | Hu | B41J 2/17546 347/19 |
| 7,242,607 | B2 * | 7/2007 | Kim | 365/149 |
| 7,311,385 | B2 * | 12/2007 | Edelen et al. | 347/57 |
| 7,427,128 | B2 * | 9/2008 | Hayasaki et al. | 347/86 |
| 8,128,205 | B2 * | 3/2012 | Benjamin et al. | 347/57 |
| 2002/0140751 | A1 | 10/2002 | Imanaka | |
| 2004/0095409 | A1 * | 5/2004 | Hu et al. | 347/19 |
| 2005/0231541 | A1 * | 10/2005 | Benjamin | 347/12 |
| 2006/0256160 | A1 | 11/2006 | Ozaki et al. | |
| 2007/0097745 | A1 | 5/2007 | Benjamin | |
| 2007/0188539 | A1 | 8/2007 | Saruta | |
| 2007/0236519 | A1 * | 10/2007 | Edelen et al. | 347/9 |

* cited by examiner

INKJET PRINT HEAD WITH SHARED DATA LINES

BACKGROUND

One of the areas of continued progress of inkjet printing is that of print heads. Development is ongoing and is working towards improved print speeds, quality and resolution, versatility in handling different ink bases and viscosity, robustness of the print heads for industrial applications, and improved width of printing swathes. Manufacturers have reduced printer prices by incorporating much of the actual print head into the cartridge itself. The manufacturers believe that since the print head is the part of the printer that is most likely to wear out, replacing it every time the cartridge is replaced can increase the life of the printer.

Modern inkjet printing is performed with a self-contained print head that includes an ink reservoir, complete with inkwell, spraying mechanism, and nozzles that can be controlled accurately. An inkjet print head may contain nozzles or orifices for the ejection of printing fluid onto a printing medium. Nozzles are typically arranged in one or more arrays such that characters or images may be printed on a medium moving relative to the nozzle array. Print head attributes that may determine print head performance include ink drop volume, pen types, ink types, and column to column nozzle spacing. Data representing the inkjet attributes is stored with the print head and can be read by the inkjet printer during initialization.

DETAILED DESCRIPTION

In describing embodiments of the present invention, the following terminology will be used.

The singular forms "a," "an," and "the" include plural referents unless the context clearly dictates otherwise. Thus, for example, reference to "a device" includes reference to one or more of such devices.

As used herein, array parameters, shapes and other quantities and characteristics are not and need not be exact, but may be approximated and/or larger or smaller, as desired, reflecting process tolerances, conversion factors, rounding off, measurement error and the like and other factors known to those of skill in the art.

Reference will now be made to the exemplary embodiments illustrated, and specific language will be used herein to describe the same. It will nevertheless be understood that no limitation of the scope of the invention is thereby intended.

Figure 1:
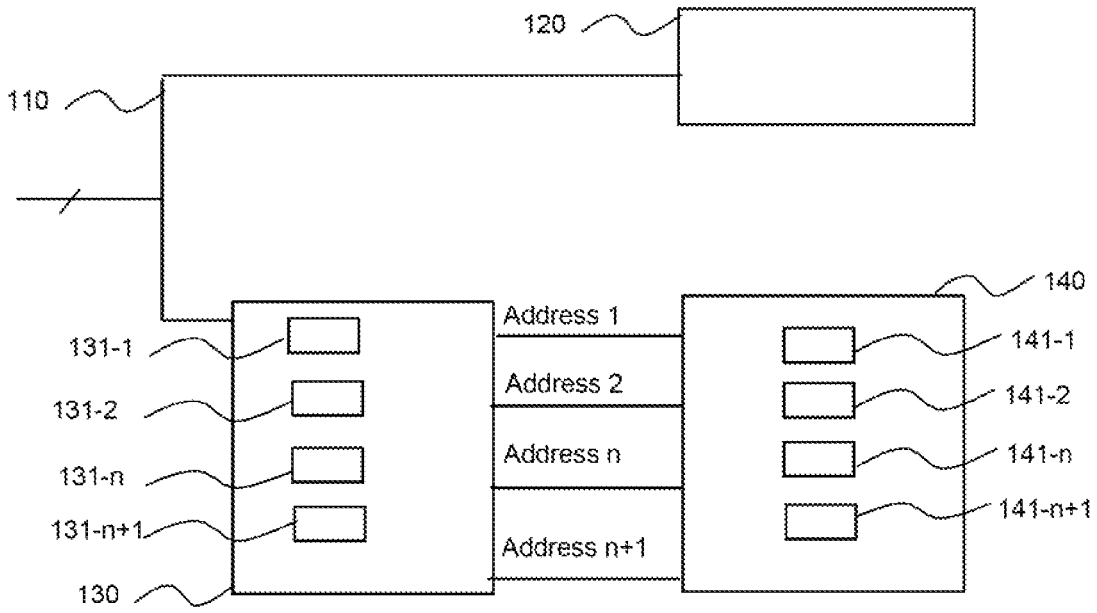
FIG. 1 depicts elements of an inkjet print head in accordance with an embodiment.

FIG. 1 illustrates an inkjet print head that includes a plurality of data signal lines 110 configured to supply inkjet control voltages to a nozzle array and to supply random access addresses to a non-volatile memory cell array. As a result, extra data signal lines are not needed for the memory cell array. The memory cell array may be used to store print head attributes such as column to column spacing, ink types, pen types, drop volume, ink availability, and other like attributes.

The fabrication of non-volatile memory cells typically uses in excess of 14 to 16 masks but the fabrication of a nozzle array may require fewer than half as many masks. Developing a process technology to fabricate both the nozzle array and the non-volatile memory array together in a single print head can be cost prohibitive. Additionally, where the nozzle array and the memory array are fabricated separately, providing interconnects between the two arrays increases costs in manufacturing and debugging.

Print heads which have devices that use fuses to store attributes require large silicon areas which may easily be visually examined to reverse engineer attribute data for cloning. The present disclosure inhibits cloning of print head attribute data by storing attribute data in non-volatile memory cells fabricated onto the same chip as the print head in a single fabrication technology with the nozzle arrays. Attribute data stored into non-volatile memory cells is less likely to be visually reverse engineered since the information is stored electronically on floating gates.

The inkjet nozzle array 120 includes a plurality of nozzles wherein each nozzle in the array is configured to communicate with a data signal line 110 which may control the nozzle through variable voltages. The non-volatile memory cell array 140 includes a plurality of memory cells wherein each memory cell in the array is accessed through the data signal line shared with the nozzle array. The non-volatile memory cell can be an EPROM (Electrically Programmable Read Only Memory), Flash memory or another type of non-volatile memory.

Only non-volatile memory cells of a chosen polarity need be programmed or written. Where a logical '1 ' is the chosen polarity of a programmed memory cell, logical '0' cells may remain unwritten. Thus only an address need be present at the memory cell array in order to write data to a non-volatile memory cell.

In an embodiment, an inkjet print head may further comprise a data to address converter 130 configured to convert data on a data signal line into a random access address on multiple random address lines 150 labeled 'Address 1', through 'Address n+1 ' in FIG. 1. A random access address, as opposed to a sequential access address, allows access to a memory cell independent of the cell access prior to or following the access of the cell at the random access address.

The data to address converter may further comprise a shift register 131-1 configured to receive data from a data signal line connected to an input data pin. The data can be used for addressing the non-volatile attribute array. A data signal line may exist for every bit latched in the shift register. 131-1 Every bit latched in the shift register 131-1 becomes an address bit that may be applied to the memory array.

To improve efficiency, a second shift register 131-2 may be configured in an embodiment to receive data from a second data signal line connected to a second input data pin to enable addressing a second portion of the non-volatile attribute array. The more shift registers (e.g., 131-1,131-2, 131-n, and 131-n+1) used in an embodiment, the less shifting of data is required to program the shift register and thus the converter becomes more efficient. In an alternate embodiment, the data to address converter may comprise transistor logic configured to generate a plurality of random access address lines. A single data line may generate two address lines by using Boolean true and complement line generation. Two address lines may generate four address lines by all possible combinations of the Boolean true and complement of the two address lines. Therefore, $2^N$ possible address lines may be generated where N is equal to the number of data lines entering the data to address converter.

In other embodiments, the non-volatile attribute memory cell array may further comprise 64 cells to 128 cells. An array may also be split into several physically discrete though logically adjacent smaller arrays to utilize existing space in the print head silicon. Arrays may be rectangular or square to fit die space requirements. One result of the present disclosure is that non-volatile memory arrays may be added to the print head without any increase in silicon area above that needed for the nozzle arrays and print head control.

Programming voltages may be generated off the print head and read currents may be sensed off the print head. Thus, support circuitry may be minimized for the memory cell array. Furthermore, the arrays are scalable to a larger number of memory cells by adding address lines for future advanced implementations.

An embodiment of the array may include multiple columns of NMOS (N-channel Metal Oxide Semiconductor) devices (e.g., 141-1,141-2,141-n,and 141-n+1) in series with a non-volatile n-channel memory device. Therefore, an inkjet print head may include only active devices characterized as NMOS devices with no PMOS (P-channel Metal Oxide Semiconductor) devices at all. Additionally, the non-volatile attribute memory cell array may include a covering over each attribute memory cell configured to prevent ultraviolet light erasure of the data stored on the non-volatile memory cell. However, erasure and programming of the array may be possible at wafer-sort prior to application of the cover.

Figure 2:
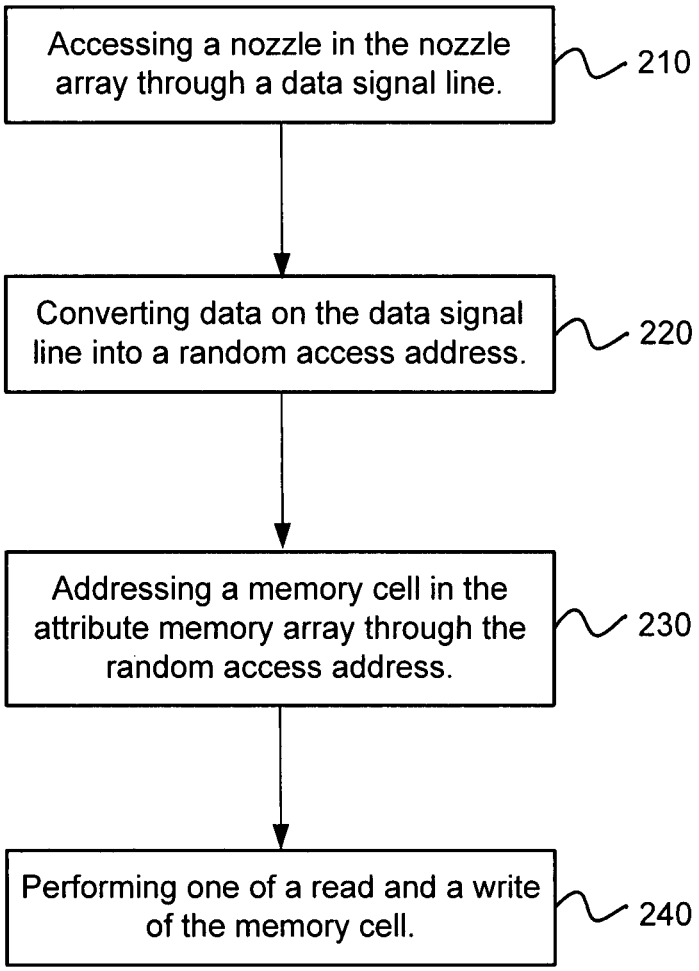
FIG. 2 depicts an embodiment of a method for using an inkjet print head having a nozzle array and a corresponding non-volatile memory cell array.

A method of using an inkjet print head having a nozzle array and a corresponding attribute non-volatile memory cell array will now be discussed. The method may include accessing a nozzle in the nozzle array through a data signal line as in step 210 depicted in FIG. 2. Data on the data signal line can be converted into a random access address as in step 220. Memory cells in the attribute memory array can be addressed through the random access address, as in step 230. A read or a write of the memory cell is performed as in step 240. The data signal line used to control a nozzle in the nozzle array is the same data signal line used to address a memory cell after the conversion of data to a random access address. One embodiment for sharing the data signal line between the nozzle array and the memory array includes latching data signals into a shift register wherein each latched signal has a corresponding signal line. The data signal lines from the shift register are applied to the memory cell array to access a memory cell at random for either a read or a write. Thus, the shift register effectively converts incoming data into a random access address. No data is necessary to address the nonvolatile memory array since the memory cell array only needs an address to program a binary '1 ' or a '0 '.

An attribute memory cell can be read by sensing a voltage or a current from a column in the memory cell array associated with a memory cell on that column at a row address. Likewise an embodiment for writing an attribute memory cell includes driving a variable voltage pulse and a variable current source into a column associated with a data signal line and a memory cell. Reading and writing a memory cell may be done using support circuitry located on or off the print head.

Figure 3:
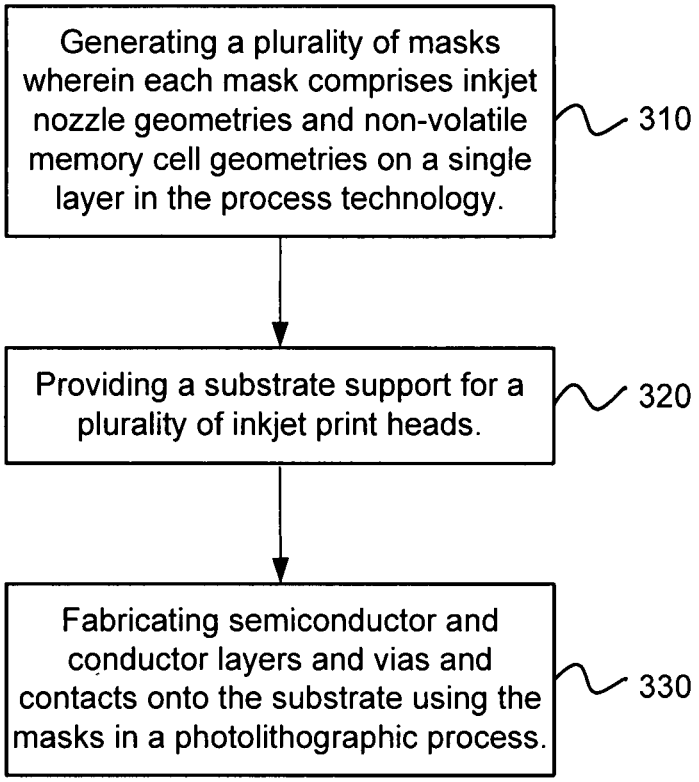
FIG. 3 depicts an embodiment of a method of making an inkjet print head in a single process technology.

A method of making an inkjet print head in a single process technology is depicted in FIG. 3. Masks are generated wherein each mask may comprise inkjet nozzle geometries and non-volatile memory cell geometries on a single layer in the process technology as in step 310. A substrate support is provided as in step 320 for the fabrication of multiple inkjet print heads as may be stepped on a single semiconductor wafer. A substrate may be cut from a silicon ingot, a glassy material, formed from a plastic, or a fabric material. Substrates provide a substantially flat surface on which to form the active semiconductor devices. The substrates used can be electrically non-conductive or may include an electrically non-conductive layer and may vary in thickness depending on the mechanical strength needed and the cost targeted in manufacturing. Semiconductor layers, conductor layers, associated vias and contacts can be fabricated onto the substrate as in step 330 using the masks in a photolithographic process.

An embodiment of a method of making an inkjet print head may further include generating masks having data signal lines shared between a nozzle array and a memory cell array. Since the fabrication technology for the non-volatile memory array has been optimized to the masks required for the nozzle array, fewer than 10 masks may be all that are needed to fabricate the memory cell array. A single process technology may include fabricating the semiconductor and conductor layers from a single master set of photolithographic masks configured to produce at least one complete print head.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An inkjet print head, comprising:

an inkjet nozzle array having nozzles;

a non-volatile memory cell array (NVMCA) including memory cells, each memory cell in the NVMCA to store data electronically in a floating gate of the NVMCA;

random access address lines;

a data to address converter (DAC) coupled via the random access address lines to the NVMCA, wherein the data to address converter further comprises transistor logic to generate a plurality of random access address signals; and a plurality of data signal lines, wherein each data signal line of the plurality of data signal lines is coupled to a nozzle of the nozzles and the DAC to supply nozzle control voltages to the nozzle and to supply non-volatile memory cell address data to address the NVMCA using a non-volatile memory cell address converted by the DAC from the non-volatile memory cell address data.

2. An inkjet print head as in claim 1, wherein the data to address converter further comprises:

a first shift register to receive data from a first input data pin for a first data signal line and to address a portion of the non-volatile attribute array; and a second shift register to receive data from a second input data pin for a second data signal line and to address a remaining portion of the non-volatile attribute array.

3. An inkjet print head as in claim 1, wherein the non-volatile attribute memory cell array further comprises 64 cells to 128 cells.

4. An inkjet print head as in claim 1, wherein the non-volatile attribute memory cell array further comprises multiple columns of n-channel devices in series with a non-volatile n-channel memory device.

5. An inkjet print head as in claim 1, wherein the non-volatile attribute memory cell array further comprises a cover over the non-volatile attribute memory cell array configured to prevent ultraviolet light erasure of the data stored on the non-volatile memory cell.

6. An inkjet print head as in claim 1, wherein the non-volatile memory cells are configured to store inkjet data attributes selected from the group consisting of column to column spacing, ink types, pen types, drop volume, and ink availability.

7. An inkjet print head as in claim 1, wherein each random access line of the random access address lines is positioned between the DAC and the NVMCA.

8. An inkjet print head as in claim 1, wherein each data signal line of the plurality of data signal lines is positioned at least between the DAC and the nozzle array.

9. A method of using an inkjet print head having a nozzle array and a corresponding attribute non-volatile memory cell array, each memory cell in the array storing data electronically in a floating gate, the method comprising:

accessing a nozzle in the nozzle array through a data signal line wherein the nozzle in the nozzle array is controlled by a variable voltage supplied through the data signal line;

converting data on the data signal line into a random access address;

addressing a memory cell in the attribute memory array through the random access address; and performing a write of the memory cell, subsequent to accessing the nozzle in the nozzle array through the data signal line, using random access addresses converted by a data to address converter from the data signal line from the plurality of data signal lines shared with the nozzle array into a plurality of random access address lines wherein a total number of the plurality of random access address lines is equal to $2^N$ wherein N is equal to a total number of the plurality of data signal lines.

10. A method of using an inkjet print head as in 9, wherein converting data on the data signal line into a random access address further comprises:

latching a plurality of data signals into a shift register wherein each latched signal has a corresponding data signal line;

applying data from the plurality of data signal lines as converted by the shift register to the memory cell array; and reading an attribute memory cell in the memory cell array at a random access address defined by the data signal lines.

11. A method of using an inkjet print head as in claim 9, wherein converting data on the data signal line into a random access address further comprises:

latching a plurality of data signals into a shift register wherein each latched signal has a corresponding data signal line;

applying data from the plurality of data signal lines as converted by the shift register to the memory cell array; and writing an attribute memory cell in the memory cell array at a random access address defined by the data signal lines.

12. A method of using an inkjet print head as in claim 10, wherein reading an attribute memory cell further comprises sensing one of a voltage and a current of a column in the memory cell array associated with a random access address of a memory cell.

13. A method of using an inkjet print head as in claim 11, wherein writing an attribute memory cell further comprises driving a variable voltage pulse and a variable current source into a column associated with a data signal line and a memory cell.

* * * * *